United States Patent [19]

Clamser et al.

[11] Patent Number: 4,598,670

[45] Date of Patent: Jul. 8, 1986

[54] SOLID FUEL FEED SYSTEM FOR A BOILER

[75] Inventors: Christian J. Clamser, Whippany; Robert A. Powers, Mountainside, both of N.J.

[73] Assignee: Foster Wheeler Energy Corporation, Livingston, N.J.

[21] Appl. No.: 751,645

[22] Filed: Jul. 3, 1985

[51] Int. Cl.[4] ..... F22B 37/42; F23K 3/00

[52] U.S. Cl. ..... 122/449; 110/101 R; 110/186; 110/101 CD

[58] Field of Search ..... 122/449; 110/186, 101 CF, 110/101 R, 101 CD; 414/187, 196

[56] References Cited

U.S. PATENT DOCUMENTS

| | | | |
|---|---|---|---|
| 668,947 | 2/1901 | Bell et al. . | |
| 1,940,945 | 12/1933 | Greene | 110/101 R |
| 2,118,651 | 5/1938 | Macchi | 110/101 CD |
| 3,412,699 | 11/1968 | Culp et al. | 110/101 R |
| 3,627,288 | 12/1971 | MacDonald | 110/186 |
| 3,865,053 | 2/1975 | Kolze et al. | 110/186 |
| 3,897,868 | 8/1975 | Smith, Jr. . | |
| 3,950,146 | 4/1976 | Funk | 110/101 R |
| 4,312,279 | 1/1982 | Wilson et al. | 110/186 |

FOREIGN PATENT DOCUMENTS

| | | | |
|---|---|---|---|
| 733006 | 3/1943 | Fed. Rep. of Germany | 110/101 CD |
| 2480407 | 10/1981 | France | 110/186 |
| 2500122 | 8/1982 | France | 110/186 |
| 58-136910 | 8/1983 | Japan | 110/186 |

*Primary Examiner*—Henry C. Yuen

*Attorney, Agent, or Firm*—Marvin A. Naigur; John E. Wilson; Warren B. Kice

[57] ABSTRACT

A solid fuel feed system for a boiler in which a hopper is provided for storing the fuel and a discharge conduit is provided for discharging the fuel to the boiler. A first conveyor belt system conveys the fuel from an inlet to the hopper and a second conveyor system transfers the fuel from the hopper to the discharge conduit. A control system is provided for controlling the speed of the first conveyor system in response to the amount of the fuel in the hopper and a second control system responds to the operation of the boiler for controlling the speed of the second conveyor system.

3 Claims, 1 Drawing Figure

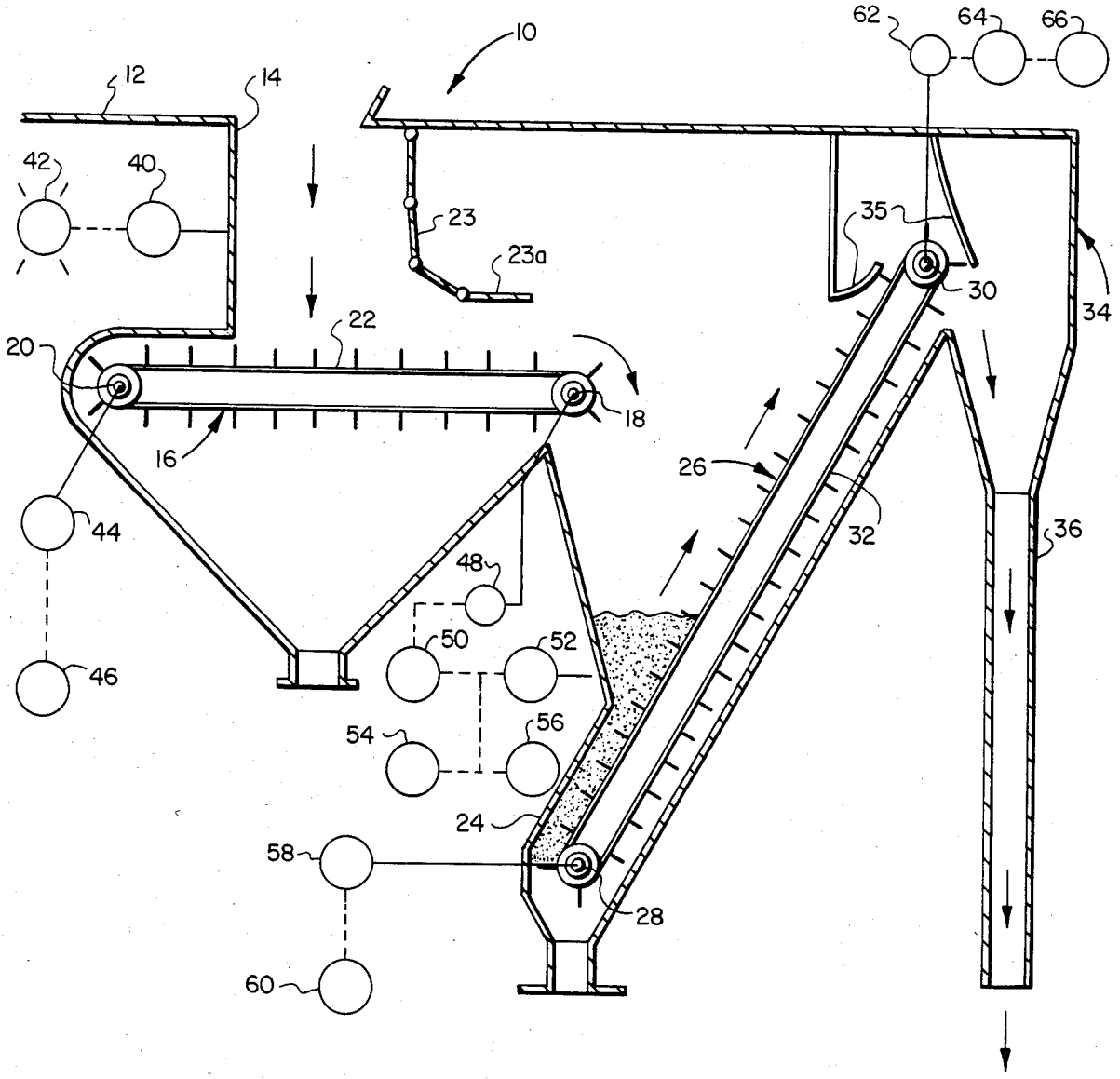
10
12
14
62
64
66
42
40
23
23a
35
30
34
22
20
18
16
26
32
36
44
48
50
52
46
54
56
24
58
28
60

SOLID FUEL FEED SYSTEM FOR A BOILER

BACKGROUND OF THE INVENTION

The present invention relates to a solid fuel feed system for a boiler and, more particularly, to such a system in which the fuel is received in an inlet, stored in a hopper, and discharged into the boiler.

Several problems are encountered in the distribution of bulk fuel material, such as refuse, from an external supply source to a boiler. For example, it is often difficult to insure a continuous flow of fuel material into a supply hopper for the boiler due to the fact that a continuous source of the fuel material and/or equipment to handle it is not always readily available. Also, the requirements of the boiler vary to an extent that the volume of the fuel material supplied to the boiler must also vary considerably. Further, since several burner systems are provided in connection with a typical boiler which are fed by separate fuel feed systems, a shutdown of one of the latter requires a corresponding change in the feeding rate of the others.

SUMMARY OF THE INVENTION

It is therefore an object of the present invention to provide a fuel feed system for a boiler in which a continuous introduction of fuel into the fuel feed system is insured despite variations in the quantity of fuel available and/or equipment for handling the fuel.

It is a still further object of the present invention to provide a fuel feed system which compensates for variable boiler firing rates.

It is a still further object of the present invention to provide a fuel feed system of the above type in which the feed system can be adjusted to compensate for shutdown for one or more burners in the boiler.

It is a still further object of the present invention to provide a fuel feed system of the above type in which the fuel is fed in a simple and efficient manner to the boiler.

Toward the fulfillment of these and other objects the boiler feed system of the present invention includes a hopper provided for storing the fuel and a discharge conduit for discharging the fuel to the boiler. A first conveyor belt system conveys the fuel from an inlet to the hopper and a second conveyor system transfers the fuel from the hopper to the discharge conduit. A control system is provided for controlling the speed of the first conveyor system in response to the amount of the fuel in the hopper, and a second control system responds to the operation of the boiler for controlling the speed of the second conveyor system.

DESCRIPTION OF THE PREFERRED EMBODIMENT

Referring to the drawing, the reference numeral 10 refers in general to the fuel feed system of the present invention which includes a horizontal receiving floor 12 for receiving solid fuel material which, by way of example, can be refuse, or the like. A skiploader, or the like (not shown), can be provided to move the fuel material from an external source to the floor 12 and towards an inlet opening 14 formed in the floor.

A horizontally-extending, endless belt conveyor system 16 is disposed immediately below the inlet opening 14 for receiving the fuel material which falls through the opening by gravity. The conveyor system 16 includes a drive pulley 18, a idle pulley 20 and an endless belt 22 extending over the pulleys in a conventional manner. The conveyor system 16 conveys the fuel material in a direction from left-to-right as viewed in the drawing before the material discharges over the right end portion of the belt 22. An articulated leveling device 23 has a horizontal portion **23*a* which extends over and parallel to the upper portion of the belt 22 to control the level of the material discharging from the conveyor system 16. A hopper 24 is disposed underneath the discharge end of the conveyor system 16** for receiving the fuel material.

An angularly-extending, endless belt conveyor system 26 is provided which has an idler pulley 28, a drive pulley 30 and an endless belt 32 extending over the pulleys in a conventional manner.

The idler pulley 28 is disposed in the hopper 24 and the drive pulley 30 extends in a storage housing 34 which receives the fuel material from the conveyor system 26 after it has been transferred from the hopper 24, as will be described. A pair of sealing devices 35 are disposed in the path of the material on the conveyor system 26 for preventing the back flow of boiler flue gas to atmosphere. A discharge conduit 36 registers with the lower end of the housing 34 for receiving the fuel material and discharging same, by gravity, to an inlet conduit, or the like (not shown), of a boiler.

A control and alarm system is associated with the conveyor systems 16 and 26 and includes a sensor 40 which senses when the level of material on the conveyor system 16 falls below a predetermined value. The sensor 40 is electrically connected to an alarm 42, which, when activated by the sensor 40, produces an audible or visual alarm.

A sensor 44 is operatively connected to the pulley 20 of the conveyor system 16 for sensing the speed of the latter system and activates an alarm 46 when the speed of the system falls below or above a predetermined value.

The drive pulley 18 of the conveyor system 16 is driven by a motor 48 which, in turn, is operatively connected to a speed controller 50. The speed controller 50 is electrically connected to a level sensor 52 which senses when the level of material in the hopper 24 falls below a predetermined value. The speed controller 50 controls the motor 48, and therefore the speed of the conveyor system 16, in response to signals from the sensor 52, and therefore the level of material in the hopper 24. A low level alarm 54 and a high level alarm 56 are connected between the controller 50 and the sensor 52 for producing an alarm when the level of the refuse in the hopper 24 is below or above a predetermined value, respectively.

A sensor 58 is operatively connected to the pulley 28 of the conveyor system 26 for sensing its speed and activating an alarm 60 accordingly, in the same manner as discussed above.

The drive pulley 30 of the conveyor system 26 is driven by a motor 62 under the conduit of a hand indicating controller 64 which, in turn, is electrically connected to a pressure recording controller 66. The latter controller is connected to a control system (not shown) for the boiler so that the conveyor system 26 is driven in response to predetermined operational parameters of the boiler.

Since the aforementioned components of the control and alarm system just described are, per se, conventional they will not be described in any further detail.

In operation, the refuse or other fuel material is received on the floor 12 and advanced toward the inlet opening 14 whereby it falls by gravity onto the upper surface of the conveyor system 16. The level of refuse on the latter conveyor system is sensed by the sensor 40 which activates the alarm 42 to produce an alarm if and when the level falls below a predetermined value.

The motor 48 of the conveyor system 16 is activated resulting in the belt 22 conveying the material toward the right end portion thereof whereby it falls into the hopper 24. The leveling device 23 operates to maintain a predetermined level of the material discharging from the belt 22, and the sensor 44 senses the speed of the pulley 20 and therefore the conveyor system 16, and activates an alarm when the speed of the system falls above or below a predetermined value.

The level sensor 52 responds to the level of material in the hopper 24 and activates the controller 50 which, in turn, operates to regulate the motor 48 and therefore the speed of the conveyor system 16 accordingly. The alarms 54 and 56 are activated in response to the material level in the hopper falling below or above a predetermined level, respectively.

The material falling into the hopper 24 by gravity from the discharge end of the conveyor system 16 is transported upwardly in the directions indicated by the arrows past the sealing devices 35 and into the housing 34 before being discharged, via the conduit 36, into the boiler. The pressure recording controller 66 responds to predetermined conditions in the boiler and activates the controller 64 which, in turn, regulates the speed of the motor 62 and therefore the speed of the conveyor system 26 to control the amount of material discharged to the boiler.

Several advantages result from the foregoing. For example, in the event that it is impossible to provide a continuous input of the fuel material to the floor 12 from the source of the fuel due to variations in the source or the equipment associated therewith, the horizontal conveying system 16 provides adequate storage to maintain a continuous feed to the inclined conveyor system 26.

Further, the speed of the inclined conveying system 26 is keyed to the boiler control system so that the feed of fuel to the discharge conduit 36, and therefore to the boiler, can be varied in response to changes in the boiler firing rates. Still further, in the event several burner systems are supplied by several fuel feed systems identical to the one described above, and one or more burner systems fail, the remaining fuel feed systems including the one described above, can be regulated to increase the feed of fuel to their respective burners and thus compensate for the failed burner.

A latitude of modification, change and substitution is intended in the foregoing disclosure and in some instance some features of the invention will be employed without a corresponding use of other features. Accordingly, it is appropriate that the appended claims be construed broadly and in a manner consistent with the spirit and scope of the invention therein.

I claim:

1. A fuel system for a boiler comprising inlet means for receiving said fuel, hopper means for storing said fuel, discharge means for discharging fuel to said boiler, first conveyor belt means extending between said inlet means and said hopper means and constructed and arranged for receiving said fuel from said inlet means and conveying said fuel to said hopper means, second conveyor belt means extending between said hopper means and said discharge means, a portion of said second conveyor means extending within said hopper means for receiving the accumulated fuel in said hopper means, said second conveyor means being constructed and arranged to transfer said fuel from said hopper means to said discharge means, first control means for controlling the speed of said first conveyor belt means in response to the amount of fuel in said hopper means, second control means responsive to the operation of said boiler for controlling the speed of said second conveyor belt means, sensing means for sensing the speed of each of said conveyor belts, alarm means connected to said sensing means for providing an alarm in response to the speed of said conveyor belt means falling below or above a predetermined value, and means associated with each of said conveyor belt means for controlling the level of said fuel on said belt means.

2. The system of claim 1 wherein said first conveyor belt means extends horizontally and receives said fuel from said inlet means by gravity.

3. The system of claim 1 wherein said second conveyor belt means extends at an angle and has one end extending in said hopper means and the other end registering with said discharge means.

* * * * *